United States Patent [19]

Ruger

[11] 4,438,678

[45] Mar. 27, 1984

[54] BOLT STOP AND CARTRIDGE EJECTOR FOR AUTO-LOADING RIFLE

[75] Inventor: William B. Ruger, Southport, Conn.

[73] Assignee: Sturm, Ruger & Company, Inc., Southport, Conn.

[21] Appl. No.: 314,437

[22] Filed: Oct. 23, 1981

[51] Int. Cl.[3] ..... F41C 15/12

[52] U.S. Cl. ..... 89/138; 42/25

[58] Field of Search ..... 89/138; 42/25

[56] References Cited

U.S. PATENT DOCUMENTS 903,998 11/1908 Mauser ..... 42/25

1,359,365 11/1920 Hammond ..... 89/138

*Primary Examiner*—Charles T. Jordan
*Assistant Examiner*—Ted L. Parr
*Attorney, Agent, or Firm*—Pennie & Edmonds

[57] ABSTRACT

An auto-loading or semi-automatic firearm having a reciprocating bolt and a magazine positioned below the path of the bolt. The bolt has a longitudinal recess therein and finger means mounted adjacent the bolt which extend into the bolt recess. The finger means are caused by magazine action, after the last discharge, to exit the bolt recess and restrain bolt movement.

4 Claims, 7 Drawing Figures

BOLT STOP AND CARTRIDGE EJECTOR FOR AUTO-LOADING RIFLE

DESCRIPTION

TECHNICAL FIELD

This invention relates to firearms having magazines and reciprocating bolts and, in particular, to auto-loading and semi-automatic firearms in which spent cartridges are ejected from the firearm during the automatic cycling of the action by an ejector, and in which the reciprocating bolt is held rearward by a bolt stop upon expenditure of the last cartridge to exhibit to the user that the last cartridge has been fired.

BACKGROUND ART

Various arrangements have been proposed for locking a bolt in its rearward position after the cartridge has been fired (see U.S. Pat. No. 3,846,928 to Ruger et al). Some arrangements engage the bolt at a point near its rearward end while others latch it in a forward area.

Certain prior mechanisms provide assemblies actuated by the magazine cartridge follower which assemblies serve to engage and thereafter to release the bolt. In other firearms the magazine cartridge follower directly engages and latches the bolt in its rearward position following expenditure of the last cartridge. Many such firearms carry cartridge ejectors employing spring-loaded plungers and other means for causing the cartridge to be propelled from the receiver in a generally random direction.

The present invention provides a novel mechanism responsive to the magazine cartridge follower for actively serving both as a bolt latch and cartridge ejector, and also serves to uniformly direct ejected cartridge cases away from centrally mounted telescopic sights.

SUMMARY OF THE INVENTION

Broadly, the present invention provides a semi-automatic or auto-loading firearm arrangement including finger means which engages the spent cartridge as it is being retracted rearwardly by the automatic rearward movement of an extracting bolt to eject the cartridge from the receiver in such a way that the finger means does not interfer with the bolt travel until the expenditure of all cartridges and the subsequent travel of the bolt to a rearward position whereupon the arrangement is then positioned to cause the finger means to interfer with and stop further movement of the bolt.

It is a feature of the invention that finger means is mounted adjacent the path of travel of the cartridge and the bolt and is positionable by the movement of the magazine follower to accomplish both ejection of cartridges and holding the bolt rearward after ejection of the last cartridge.

It is a further feature that cartridges are ejected from the receiver along a trajectory that avoids cartridges striking any telescopic sight which is mounted on the firearm.

DESCRIPTION OF THE PREFERRED EMBODIMENT

Figure 1:
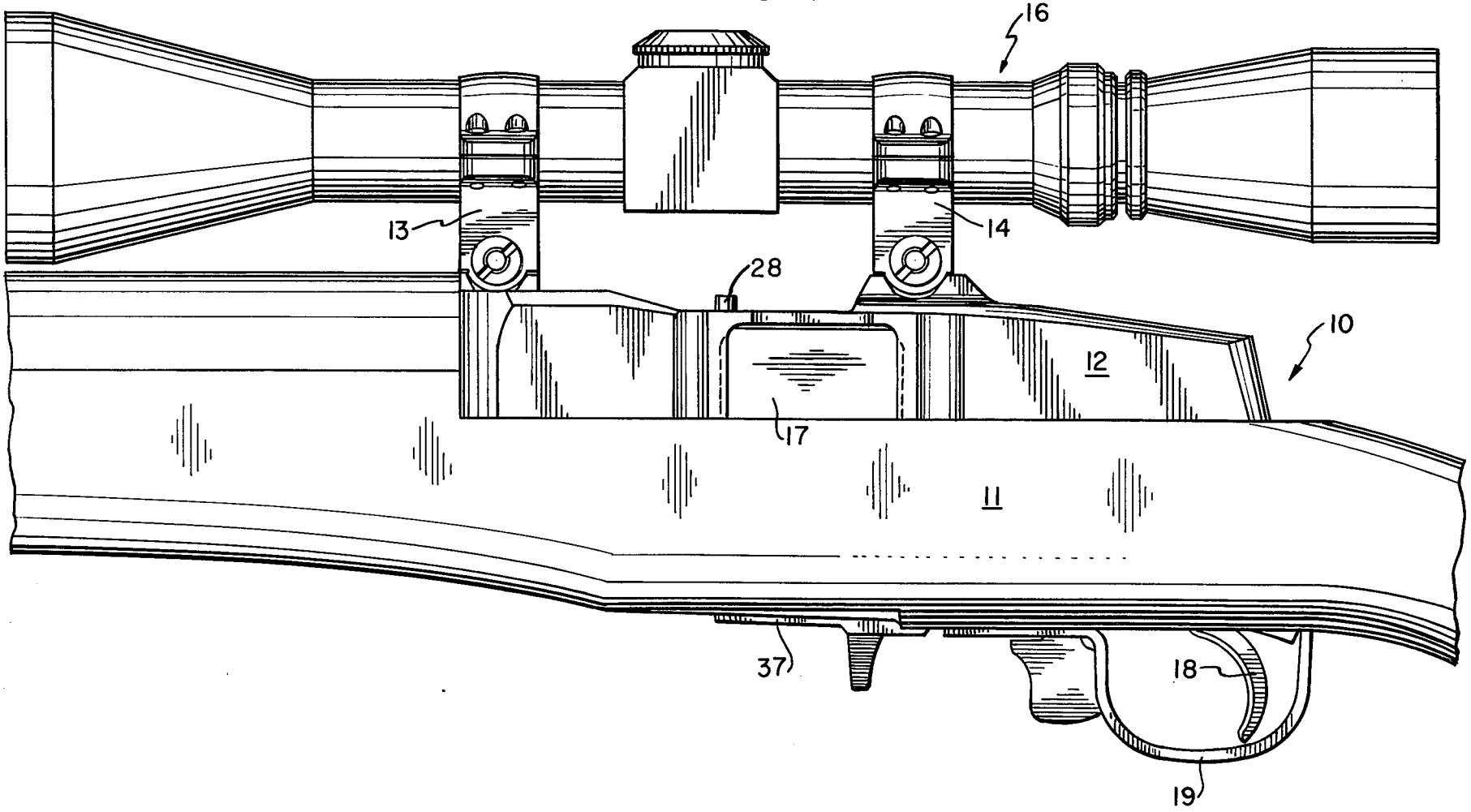
FIG. 1 is a partial side elevational view of the rifle including scope.
Figure 2:
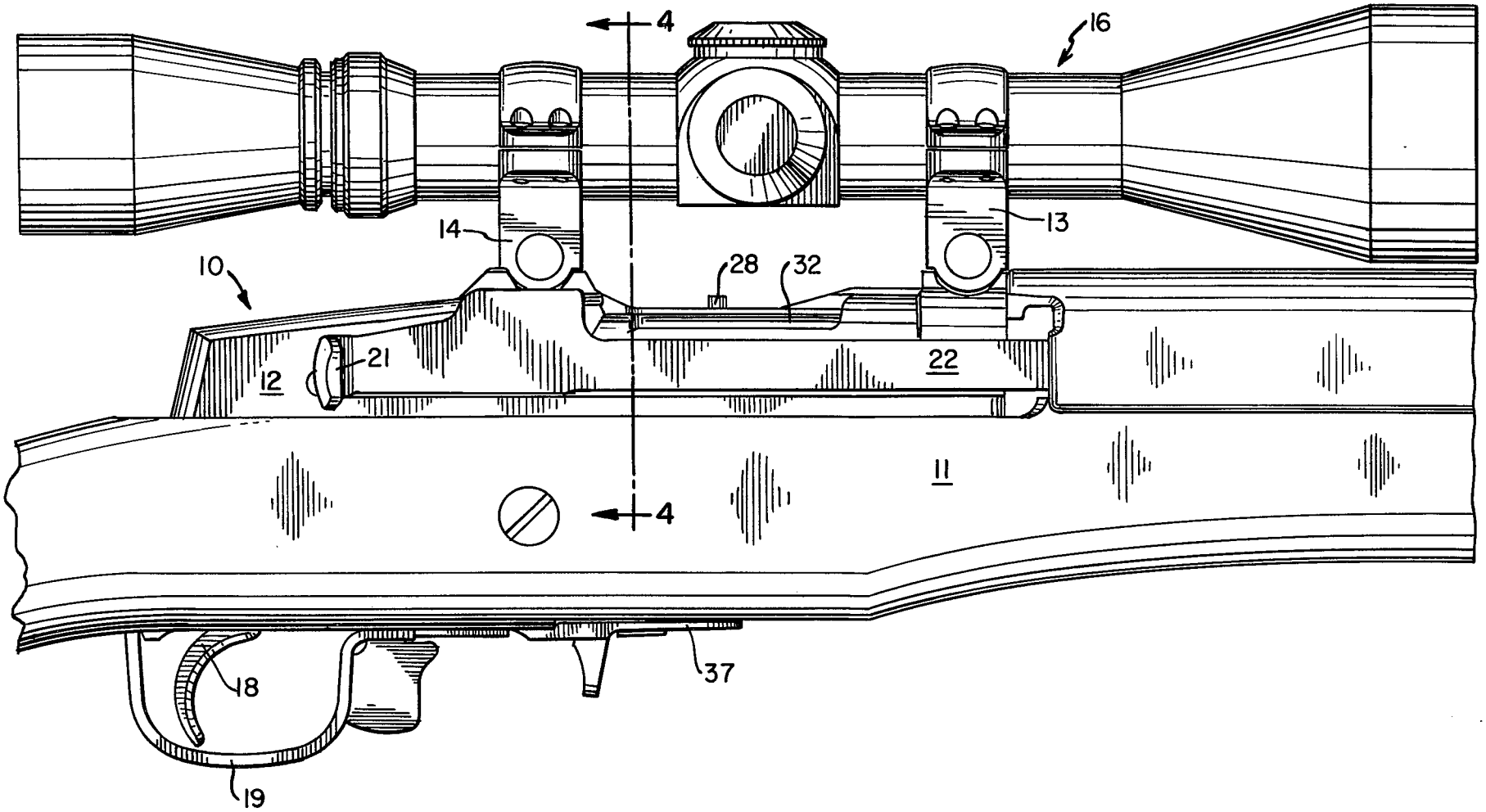
FIG. 2 is a partial elevational view of the opposite side of the rifle.

In FIGS. 1 and 2, rifle 10 includes stock 11, receiver 12, forward scope support 13, rear scope support 14 and scope 16. Also shown is removable panel 17, trigger 18 and trigger guard 19. Cocking handle 21 and slide 22 are also shown.

Turning to FIGS. 3–6, bolt latch ejector lever arm 23 is mounted about pivot 24 on receiver 12. The rear portion 26 of the lever arm 23 is moved up by action of magazine cartridge follower 27 against the normally biased downward action of spring return plunger 28 on forward beak portion 29 (see FIGS. 3 and 5).

Figure 4:
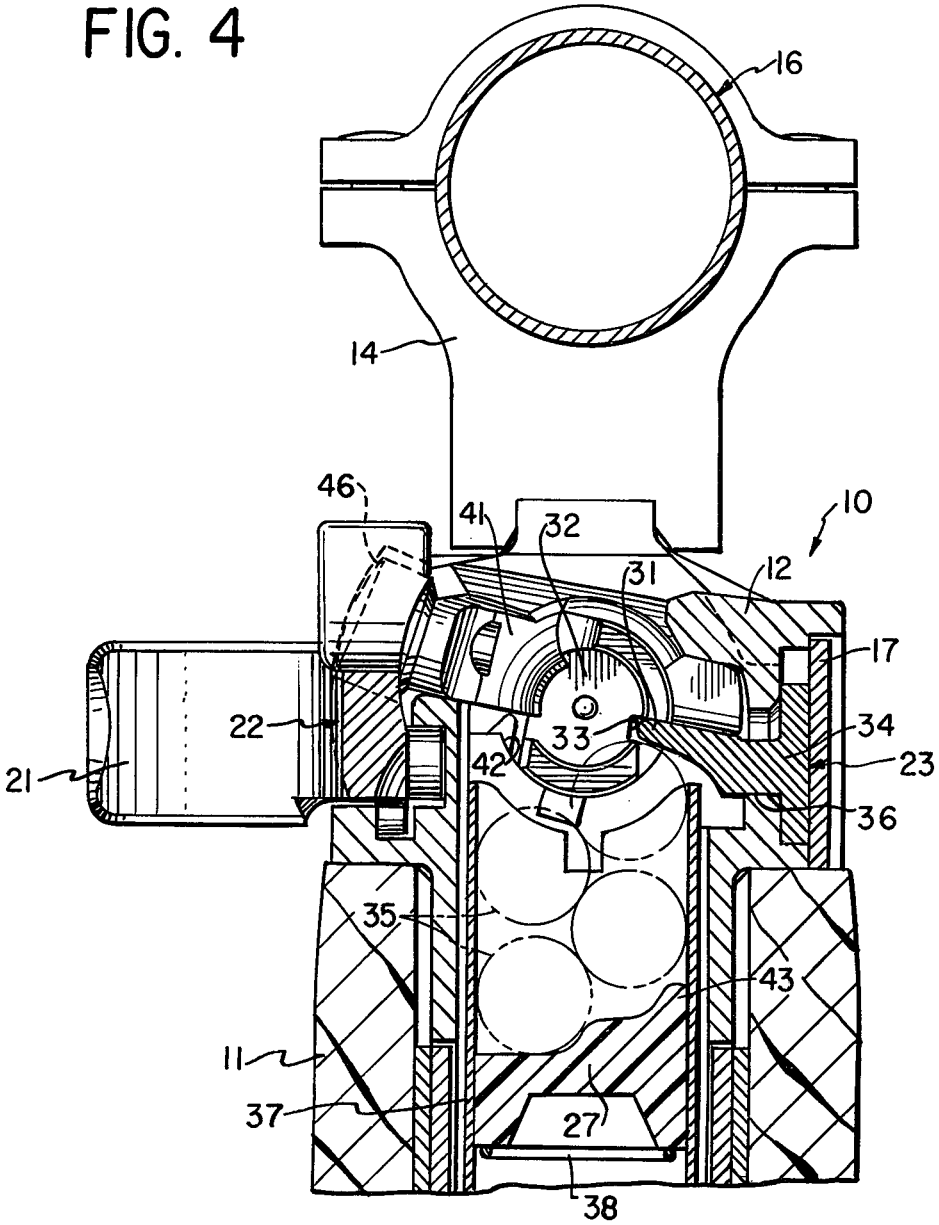
FIG. 4 is a sectional view along line 4—4 of FIG. 2 showing the bolt latch ejector lever positioned to eject cartridges but not latch the bolt.
Figure 6:
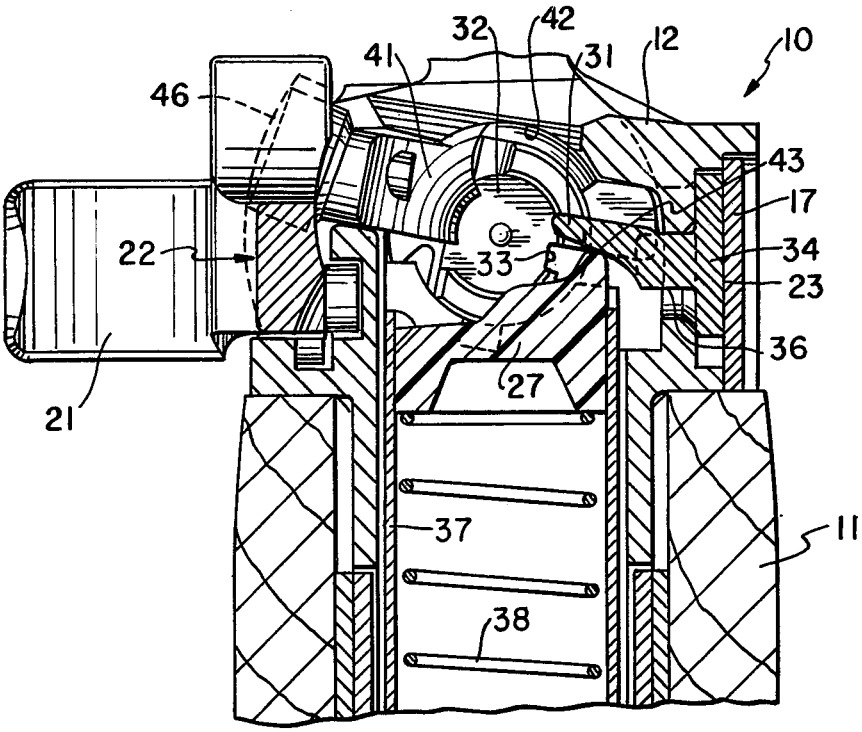
FIG. 6 is a sectional view along line 6—6 of FIG. 5 showing bolt latch ejector lever positioning to both eject and latch.

Turning in particular to FIGS. 4 and 6, it is seen that lever arm 23 includes ejector finger 31 positioned to engage a cartridge 35 as bolt 32 retracts. Bolt 32 has a longitudinal finger recess 33 which permits bolt 32 to reciprocate past finger 31 without interference with it when finger 31 is in its down position (FIG. 4). However, when cartridge follower 27 causes finger 31 to move to its up position bolt 32 is latched in its rearward position by finger 31 (FIG. 6).

Figure 5:
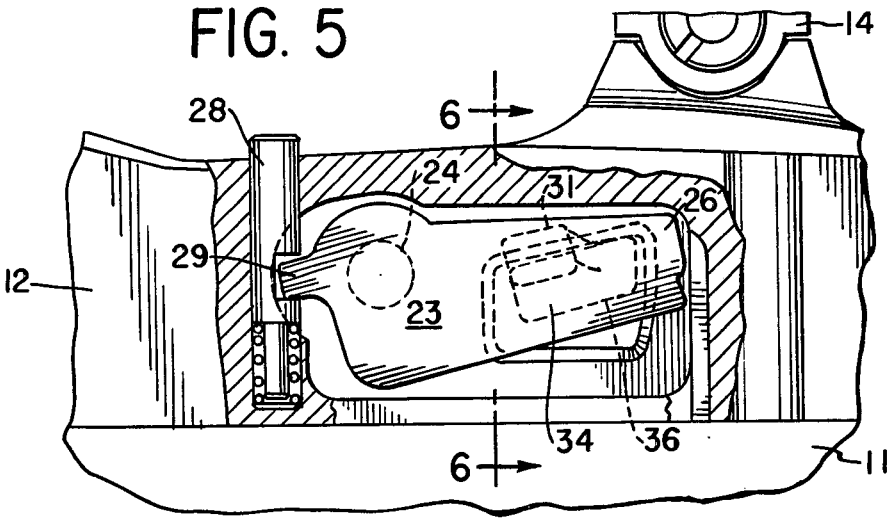
FIG. 5 is an enlarged sectional elevational view showing the bolt latch ejector lever in its latch position.

Further to FIGS. 4–6, lever arm 23 includes lever plate 34 and finger support piece 36. Cartridge magazine 37 houses cartridges 35 which are urged upperwardly by follower 27 and follower spring 38. The forward end of bolt 32 carries stationary extractor jaws 39 and spring-loaded extractor jaw 41. Bolt handle cam 46 is engaged by slide 22 to reciprocate and rotate in receiver chamber 42.

Figure 7:
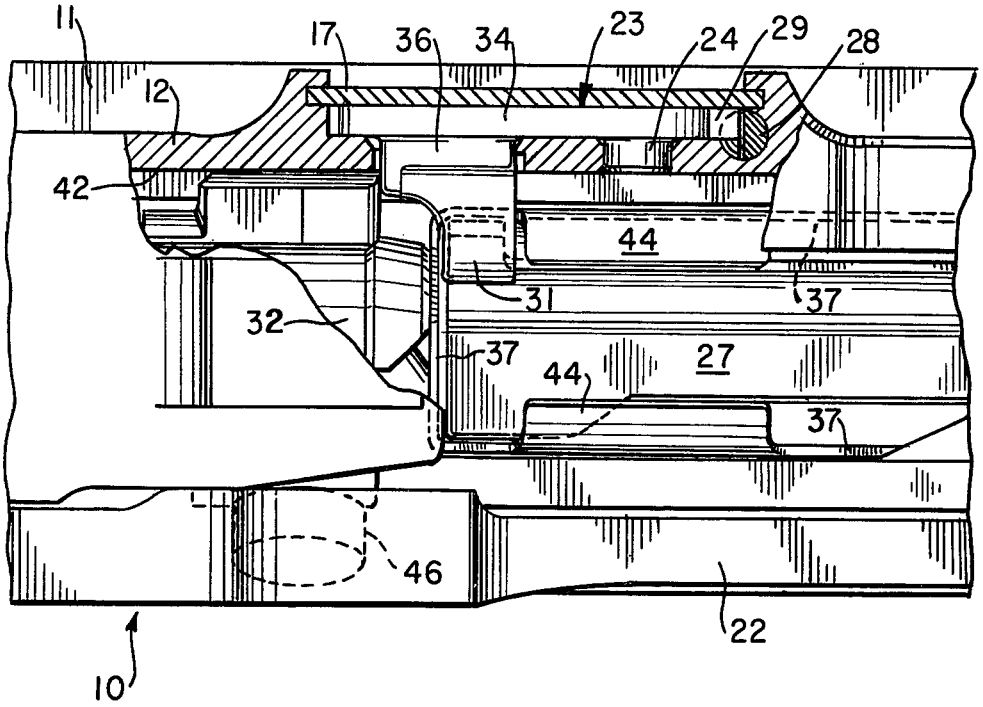
FIG. 7 is a partial plan view of the rifle with the bolt back and magazine cartridge follower engaging the latch ejector lever.

Turning to FIG. 7, cartridge follower 27 includes forward projection 43 (shown in dashed lines) for engaging finger 31 to raise it as follower 27 reaches its uppermost position against magazine follower retainer lips 44. Also shown are panel 17, slide 22, latch ejector lever arm 23 including its plate 34, finger support piece 36 and finger 31. Bolt 32, including extractor jaw 39 and handle cam 46, is in its rearward position.

Figure 3:
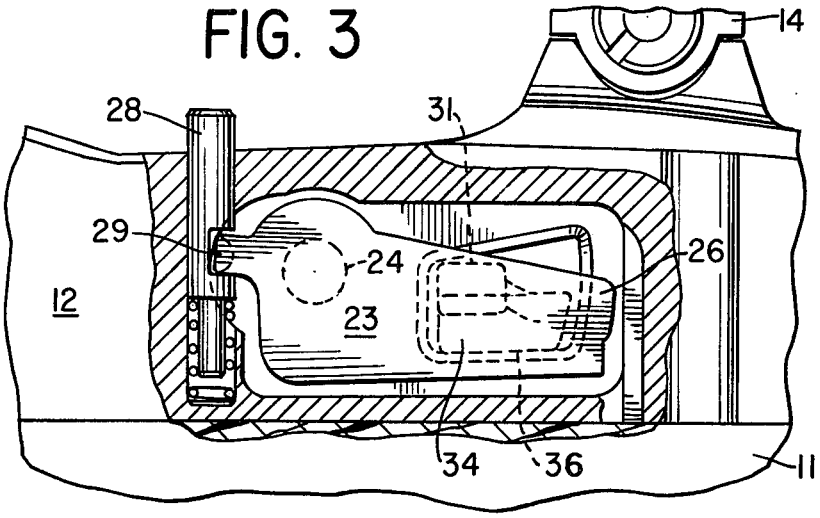
FIG. 3 is an enlarged sectional elevational view showing the bolt latch ejector lever in its non-latch position.

In the operation of rifle 10 with one or more cartridges 35 in magazine 37, projection 43 on cartridge follower 27 is held below finger 31 of latch ejector lever 23 (FIG. 4) permitting rear portion 26 to assume its down position (FIG. 3). When bolt 32 is moved forward causing cartridge 35 to be chambered, finger 31 clears bolt 32 by passing through bolt recess 33. Upon the automatic rearward movement of bolt 32 after firing of the rifle, finger 31 engages the cartridge 35 causing the cartridge to reorient to the extent that it is disengaged from the grip of the extractor jaws 39, 41 and propelled clear of the receiver 12. Due to the position on the spent cartridge circumference as engaged by finger 31, the spent cartridge is ejected in a low trajectory to avoid striking scope 16.

After the last cartridge has been expended, bolt 32 automatically travels rearwardly and, as it does, it depresses magazine follower 27 sufficiently so that projection 43 is unable to lift finger 31. However, once bolt 32 retracts rearwardly past follower 27, follower 27 with its projection 43 rises to move lever 23 to its stop position. Bolt 32 is thereafter held against further forward movement through interposition of finger 31.

The use of finger projection means within the contemplation of this invention includes the concept of configuring a bolt to define a cross sectional path of movement so that finger means mounted adjacent the cross sectional bolt path can be selectively moved into and out of the bolt path to lock and unlock the bolt. The same finger means in their bolt unlocked position interfer with the cross sectional path of the spent cartridge to eject it as it is moved rearwardly providing versatile use of finger means to accomplish both bolt latching and cartridge ejection.

I claim:

1. In an auto-loading or semi-automatic firearm having a barrel, a cartridge chamber in the barrel, a receiver rearward of the barrel, a reciprocating bolt, a magazine beneath the path of the bolt which magazine includes a magazine follower movable along an upward path to deliver cartridges to the bolt for reciprocating movement in engagement with the bolt forward to the chamber and then rearward from the chamber and a bolt stop, the improvement comprising (a) longitudinal bolt recess means in the bolt extending to and through the forward end of such bolt;

(b) rotatable finger mounting means adjacent the path of reciprocal movement of the bolt which finger mounting means rotates about an axis substantially perpendicular to the upward path of the magazine follower;

(c) finger means mounted on the finger mounting means for movement substantially in a plane perpendicular to such bolt reciprocating path; said finger means extending into the bolt recess means as the bolt is cycled past the finger means during the normal firing reciprocation of the bolt means; said finger means causing spent cartridges to be ejected; and (d) finger mounting means responsive to upward movement of the magazine follower for moving said finger means as mounted on the rotatable finger mounting means upon emptying of the magazine and movement thereafter of the bolt rearwardly past the magazine such finger means movement moving the finger means out of the forward end of said bolt recess as the bolt in rearward movement passes the finger means and as so moved the finger means engages the bolt to prevent the bolt from again passing the finger means during its forward reciprocation.

2. In a firearm having a barrel, a cartridge chamber in the barrel, a receiver rearward of the barrel, a bolt mounted for longitudinal travel in the receiver, a magazine beneath the path of the bolt which magazine includes a follower to deliver cartridges into the path of the bolt, bolt cartridge carrying and extractor means for carrying the cartridge in a forward path and thereafter extracting it from the chamber for movement in a rearward path, and a bolt stop, the improvement comprising (a) bolt means configured to define a cross sectional path as the bolt moves forwardly and rearwardly different from the cross sectional path of the cartridge as the cartridge is held by the extractor means and moved rearwardly, said difference being a longitudinal recess extending from the forward end of the bolt means a substantial distance;

(b) finger means mounted adjacent the paths of the bolt and cartridge;

(c) movable means (1) for moving the finger means to a first position in said recess which does not interfere with the configured cross sectional path of the bolt means (2) for moving the finger means to a second position out of the recess as the bolt passes to the rear of the finger means and (3) for holding the finger means in the second position to latch the bolt, said movable means being responsive to the magazine follower.

3. The improvement of claim 2 in which the movable means are in turn moved from the first position of the finger means to the second position of the finger means by the magazine follower after (1) the last cartridge has been expended and (2) the bolt retracts to its rearward position.

4. In a firearm having a receiver, a bolt mounted for longitudinal path movement in the receiver, magazine means for delivering a cartridge to the receiver for movement longitudinally in the receiver along a cartridge path and a bolt stop, the improvement comprising (a) bolt means configured in cross section so that the cross sectional path of the bolt and the cross sectional path of the cartridge are different;

(b) movable finger means mounted adjacent said bolt path and said cartridge path for movement from a first position in which the finger means is positioned in both the bolt path and the cartridge path to a second position in which the finger means is only in the cartridge path; and (c) magazine follower means to move the finger means to the first position when the magazine follower is in its most upper position and having spring return means to move the finger means to its second position when the follower means is below its most upper position.

* * * * *